US005761935A

United States Patent [19]

Adelmeyer

[11] Patent Number: 5,761,935

[45] Date of Patent: Jun. 9, 1998

[54] WEATHERPROOF PADLOCK

[75] Inventor: Gerard G. Adelmeyer, Anaheim, Calif.

[73] Assignee: Emhart Inc., Newark, Del.

[21] Appl. No.: 903,399

[22] Filed: Jul. 30, 1997

[51] Int. Cl.[6] ..... E05B 67/38

[52] U.S. Cl. ..... 70/55; 70/455

[58] Field of Search ..... 70/50–52, 54–56, 70/417, 423, 424, 455, DIG. 43, DIG. 56; D8/334, 346

[56] References Cited

U.S. PATENT DOCUMENTS

| | | | |
|---|---|---|---|
| 1,662,612 | 3/1928 | Junkunc | 70/455 |
| 3,848,440 | 11/1974 | Manuel | 70/55 |
| 3,858,419 | 1/1975 | Hampton | 70/55 |
| 4,154,072 | 5/1979 | Flaschar | 70/455 |
| 4,218,902 | 8/1980 | Druschel | 70/55 |
| 4,224,813 | 9/1980 | Hampton | 70/51 |
| 4,226,100 | 10/1980 | Hampton et al. | 70/51 |
| 4,286,445 | 9/1981 | Sills | 70/55 |
| 4,297,861 | 11/1981 | Dykes | 70/55 |
| 4,317,344 | 3/1982 | Barnard | 70/55 |
| 4,651,543 | 3/1987 | Heald | 70/54 |
| 5,156,029 | 10/1992 | Heald | 70/55 |

*Primary Examiner*—Lloyd A. Gall
*Attorney, Agent, or Firm*—Spencer T. Smith

[57] ABSTRACT

A weatherproof casing for a padlock having a body and a shackle. A lower casing includes a body, a bottom cap having a flat bottom and an annular wall projecting therefrom, and a strap connecting the body and the bottom cap. The casing body includes an upper portion conforming to the shape of the padlock body and open at the top for receiving the body of the padlock, and an upper casing in the form of a cap having an annular downwardly projecting flange defining an opening for receiving the top of the lower casing body. The lower casing body additionally includes an enlarged flange at the bottom defining a second opening for receiving the annular wall of the bottom cap. The strap extends between the side of the bottom of the bottom cap and the side of the enlarged flange proximate the top thereof.

3 Claims, 2 Drawing Sheets

WEATHERPROOF PADLOCK

The present invention relates to padlocks and more particularly to padlocks which are enclosed within a plastic case to weatherproof the padlock.

BACKGROUND OF THE INVENTION

Padlocks have been covered or shrouded with plastic cases to isolate the padlock from the elements. Numerous U.S. Pat. Nos. disclose such covered padlocks including: 1,662,612, 2,904,985, 3,422,643, 3,453,758, 3,848,440, 3,858,419, 3,983,725, 4,224,813, 4,226,100, 4,286,445, 4,297,861, 4,317,344, 5,033,279, 5,156,029, Des. 325,158, Des. 341,766, Des. 342,009, and Des. 342,010.

OBJECT OF THE INVENTION

It is an object of the present invention to provide an improved weatherproof casing for a padlock.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE PREFERRED EMBODIMENT

Figure 1:
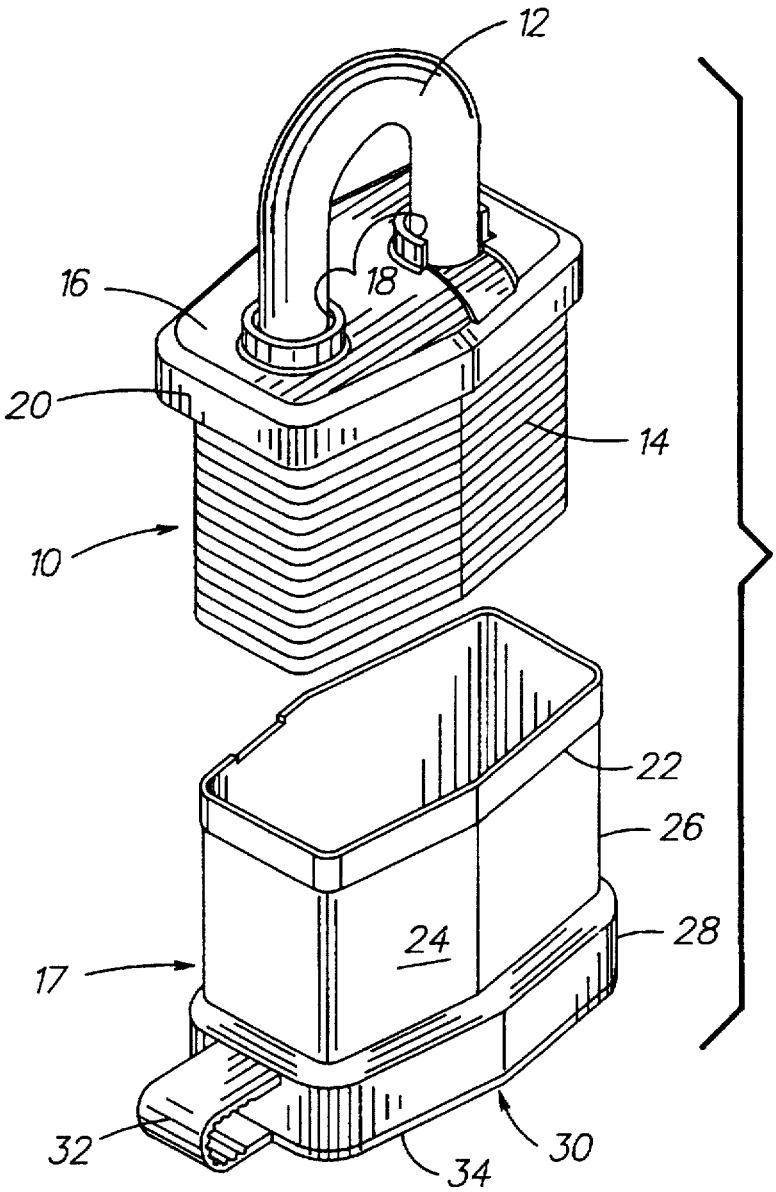
FIG. 1 is an oblique view of a partly assembled weatherproof padlock made in accordance with the teachings of the present invention.

The padlock 10 has a shackle 12 and a body 14 which in the illustrated embodiment is of laminate construction. The weatherproof casing for the padlock is made up of a top casing in the form of a cap 16 and a lower casing 17. The cap 16 has holes 18 in its top surface to accommodate the shackle 12 and an internal annular recess (not shown) proximate the bottom of the downwardly projecting annular side wall 20 to capture an annular bead 22 proximate the top of the casing body 24 of the lower casing 17 to interconnect the top casing and the lower casing. The casing body 24 is made up of a top portion 26 which conforms to the shape of the padlock body and an enlarged annular flange portion 28 which is connected to a bottom cap 30 via a strap 32.

Figure 2:
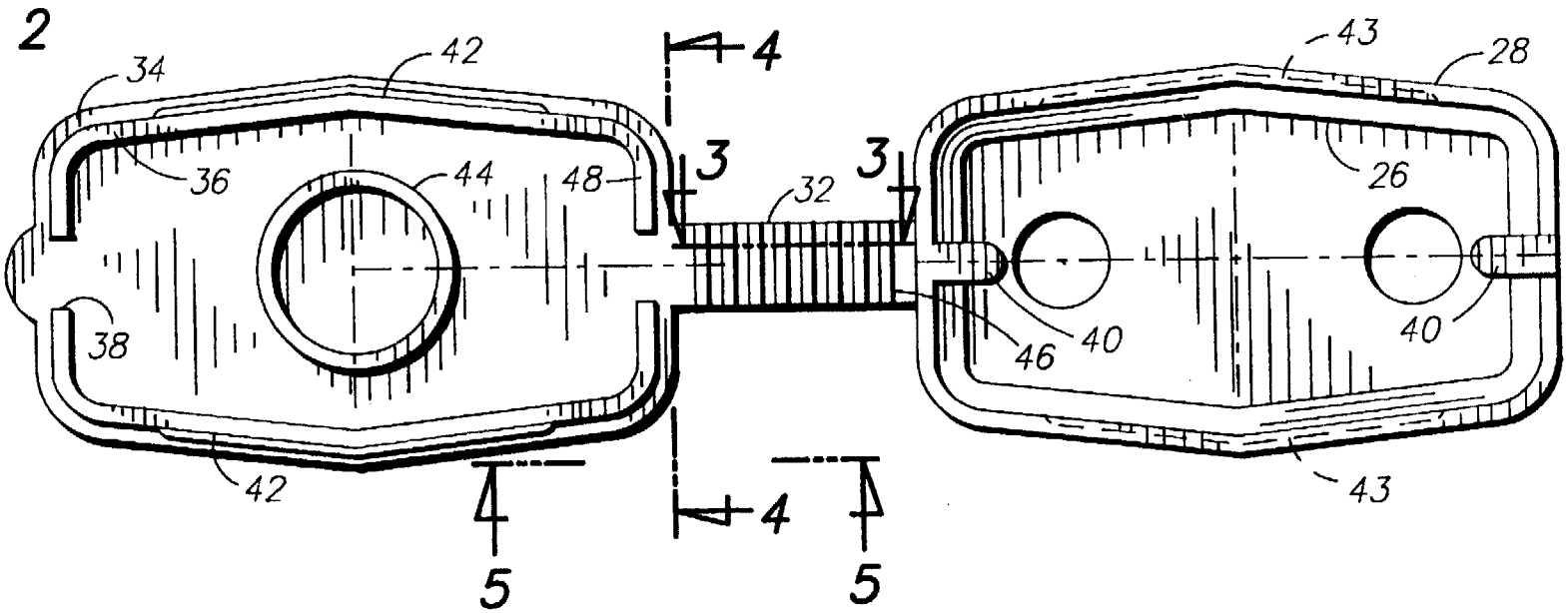
FIG. 2 is a portion of the weatherproof casing, as manufactured, looking towards the undulating side of the connecting strap.
Figure 3:
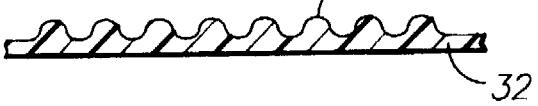
FIG. 3 is a view taken at 3—3 of FIG. 2.
Figure 4:
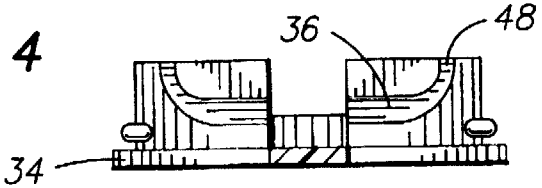
FIG. 4 is a view taken at 4—4 of FIG. 2.
Figure 5:
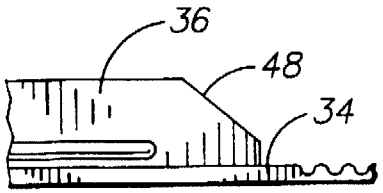
FIG. 5 is a view taken at 5—5 of FIG. 2.

As can be seen from FIG. 1, the bottom cap 30, which has a flat bottom 34, engages the bottom of the enlarged annular flange 28 to finnish the bottom of the lower casing body 24. The side of the bottom cap is flush with the enlarged annular flange. The bottom cap 30 also has an upwardly projecting annular wall 36 (FIGS. 2, 4 and 5) which will be matingly received within the enlarged annular flange 28. This annular wall has cut outs 38 at either end to accommodate a pair of inwardly projecting struts 40 at the bottom of the annular flange 28, which limit the insertion of the padlock body. A pair of ridges 42 extend outwardly from the long sides of the annular wall which will be captured by corresponding notches 43 defined in the interior surfaces of the long sides of the enlarged annular flange. The interior surface of the bottom cap has a raised circular ridge 44 which is intended to engage the bottom surface of the padlock body around the key opening to protect that opening.

The connecting strap 32, extends from the flat bottom of the bottom cap 30 to the enlarged annular flange, proximate its top, and has an undulating surface 46 on the inside surface (as bent). The end of the annular wall, proximate the strap, is beveled 48 to facilitate insertion of the bottom cap into the enlarged annular flange.

I claim:

1. A weatherproof casing for a padlock having a body and a shackle comprising a lower casing including a body, a bottom cap having a flat bottom and an annular wall projecting therefrom, and a strap connecting said body and said bottom cap, said casing body including an upper portion conforming to the shape of the padlock body and open at the top for receiving the body of the padlock, and an upper casing in the form of a cap having an annular downwardly projecting flange defining an opening for receiving the top of said lower casing body, said lower casing body additionally including an enlarged flange at the bottom defining a second opening for receiving the annular wall of said bottom cap, said strap extending between the side of the bottom of said bottom cap and the side of said enlarged flange proximate the top thereof.

2. A weatherproof casing for a padlock according to claim 1, wherein said strap is fluted on the inside surface.

3. A weatherproof casing for a padlock according to claim 1, wherein the portion of the annular wall of said bottom cap proximate said strap is bevelled.

* * * * *